US006434785B1

(12) United States Patent
Vandenbelt et al.

(10) Patent No.: US 6,434,785 B1
(45) Date of Patent: Aug. 20, 2002

(54) DUAL FILTER WET/DRY HAND-HELD VACUUM CLEANER

(75) Inventors: Rudy A. Vandenbelt; Bjarki Hallgrinsson, both of Ottawa (CA)

(73) Assignee: Headwaters Research & Development, Inc, Ottawa (CA)

( * ) Notice: Subject to any disclaimer, the term of this patent is extended or adjusted under 35 U.S.C. 154(b) by 0 days.

(21) Appl. No.: 09/553,139

(22) Filed: Apr. 19, 2000

(51) Int. Cl.[7] ..... A47L 9/12; A47L 9/18
(52) U.S. Cl. ..... 15/344; 15/353
(58) Field of Search ..... 15/344, 347, 353

(56) References Cited

U.S. PATENT DOCUMENTS 4,213,224 A * 7/1980 Miller ..... 15/344
4,542,557 A * 9/1985 Levine ..... 15/344
4,577,365 A * 3/1986 Yuen ..... 15/344 X
4,821,366 A * 4/1989 Levine ..... 15/344
4,831,685 A * 5/1989 Bosyj et al. ..... 15/347 X
4,833,753 A 5/1989 Muller
4,924,548 A * 5/1990 Touya et al. ..... 15/344 X
5,020,187 A * 6/1991 Kosten et al. ..... 15/344 X
5,065,473 A * 11/1991 Krasznai et al. ..... 15/344 X
5,135,552 A 8/1992 Weistra
5,561,885 A * 10/1996 Zahuranec et al. ..... 15/344 X
5,733,351 A 3/1998 Hult et al.
6,108,864 A * 8/2000 Thomas et al. ..... 15/344 X
6,125,501 A * 10/2000 Yip ..... 15/344

* cited by examiner

*Primary Examiner*—Chris K. Moore
(74) *Attorney, Agent, or Firm*—Albert Peter Durigon

(57) ABSTRACT

A dual filter wet/dry hand-held vacuum cleaner includes a two-stage filtration system effective to provide liquid and/or dry pick-up while minimizing the frequency with which it needs cleaned out that, at cleanup time, may be cleaned efficiently with little or no dust generation and minimal or no direct contact with accumulated grime.

14 Claims, 4 Drawing Sheets

DUAL FILTER WET/DRY HAND-HELD VACUUM CLEANER

FIELD OF THE INVENTION

This invention is drawn to the field of vacuum cleaners, and more particularly, to a novel dual filter wet/dry hand-held vacuum cleaner.

BACKGROUND OF THE INVENTION

Wet/dry hand-held vacuum cleaners are portable devices useful in home, office and other environments to provide pick-up of dirt and/or liquid spillage. When not in use, they are typically stored, together with any accessories, on a recharging base unit. U.S. Pat. No. 4,831,685 issued May 23, 1989 to Bosyjl et al., incorporated herein by reference, is exemplary of the heretofore known wet/dry hand-held vacuum cleaners.

The more times they are used, and the longer they are operated each time, the greater is the dirt and/or liquid spillage that accumulates therewithin until the point is reached beyond which the cleaning power of the units is noticeably reduced. At each such time, whether after multiple small cleaning jobs or during a single large one, the units must be emptied of the accumulated grime.

Wet/dry hand-held vacuum cleaners are thus called upon to provide filtration effective to accumulate solid and liquid matter, to provide such filtration for as long as possible before their cleaning power is noticeably reduced and, at the times of emptying, to provide efficient clean-up.

SUMMARY OF THE INVENTION

Accordingly, it is the principal object of the present invention to disclose a novel dual filter wet/dry hand-held vacuum cleaner effective to provide liquid and/or dry pick-up while minimizing the frequency with which it needs cleaned out that, at cleanup time, may be cleaned efficiently with little or no mess.

The dual filter wet/dry hand-held vacuum cleaner of the present invention includes a powered unit; an elongated dust bowl removably attached to the powered unit having an intake nozzle that discharges a stream in which dirt and/or liquids may be entrained; a first filter mounted in the dust bowl that receives the intake nozzle stream and discharges filtered air from which liquids and comparatively-large particulates that may be present in the intake nozzle stream have been separated; and a second filter intermediate the first filter and the powered unit that receives the filtered air from the first filter and discharges purified air from which comparatively-small particulates that may be present in the filtered air have been separated. The dual filter wet/dry hand-held vacuum cleaner of the present invention in this manner provides effective filtration of liquids and solids and thereby provides-clean, healthy environments that are substantially free of dirt, dust, allergens and bacteriological pollutants.

Because the first filter separates liquids and such comparatively-large particulates as dirt particles, lint, hair and dead skin from the intake nozzle stream, the second filter is allowed to remove such comparatively-small particulates as pollen, other allergens and fine dust from the filtered air without becoming clogged by comparatively-large particulates, which maximizes the collection efficacy of the second filter and therewith minimizes the frequency with which it needs cleaned or replaced.

The first filter preferably includes a frame slidably mounted in the dust bowl that is substantially coextensive with a major portion thereof. The frame substantially coextensive with the dust bowl maximizes the particulate trapping capacity of the first filter and therewith minimizes the frequency when it needs to be cleaned out.

The frame of the first filter preferably has top, and open bottom, side and end walls that bound an interior volume. One end wall is adapted to receive the intake nozzle so that it opens into the interior volume of the frame of the first filter. Metallic screens are mounted to the open side and bottom walls that separate comparatively-large particulates and liquids from the intake nozzle stream, and the other open end wall of the frame provides a discharge end. At emptying time, the accumulated dirt may be discharged from the interior volume and through the open discharge end of the frame of the first filter directly into a suitable trash receptacle, which minimizes dust generation and direct user contact with dirt. Any liquid that passes through the side and bottom screens is accumulated in the dust bowl, which, at cleanup time, may be separately discharged by emptying the dust bowl into a suitable liquid receptacle.

The second filter preferably includes a cover removably attached to the powered unit; a flange providing a flat filter mounting recess formed about the dust bowl receiving face of the powered unit; and one of a foamed plastic flat filter, a HEPA flat filter and a ULPA flat filter that is removably mounted to the mounting recess of the powered unit. At cleaning or replacement times, the flat filter mounted in the filter mounting recess may be readily removed, and cleaned or replaced.

Any suitable filter arrangement to separate comparatively-large and comparatively-small particulates from the intake nozzle stream and any suitable seal arrangement to provide fluid-tight first and second filter fluid communication and to prevent dirt and liquid ingress from the dust bowl to the powered unit may be employed.

BRIEF DESCRIPTION OF DRAWINGS

These and other objects, inventive aspects, and advantageous features of the present invention will become apparent as the invention becomes better understood by referring to the following solely exemplary detailed description of the presently preferred embodiments thereof, and to the drawings, wherein.

DETAILED DESCRIPTION OF THE PRESENTLY PREFERRED EMBODIMENTS

Figure 1:
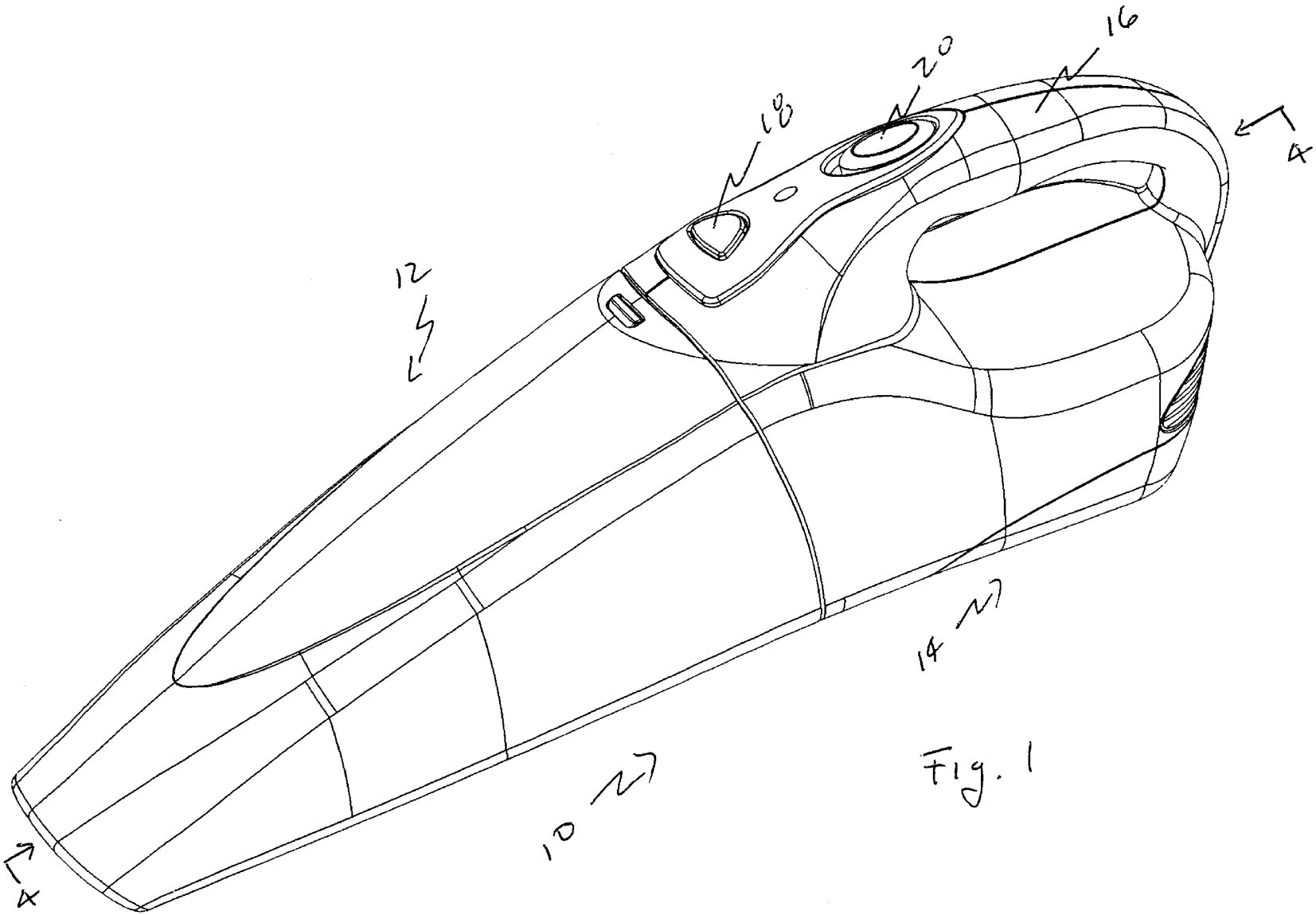
FIG. 1 is a perspective view showing a presently preferred embodiment of a dual filter wet/dry hand-held vacuum cleaner in accord with the present invention.

Referring now to FIG. 1, generally designated at 10 is a perspective view showing a presently preferred embodiment of the dual filter wet/dry hand-held vacuum cleaner in accord with the present invention. The dual filter wet/dry hand-held vacuum cleaner 10 includes an elongated dust bowl generally designated 12 having an intake nozzle at the proximate end thereof and a powered unit generally designated 14 having a dust bowl receiving face to which the dust bowl 12 is removably attached. The powered unit 14 includes a handle member 16, and a dust bowl release button 18. A power switch 20 is operatively connected in well-known manner to a rechargeable battery that powers a motor whose shaft turns a vacuum impeller blade, all not shown, that are mounted in the powered unit. An easy-to-clean, two-stage filter to be described intermediate the intake nozzle and powered unit effectively removes dirt and/or liquids that may be entrained in the intake nozzle stream and discharges purified air cleaned of comparatively-large and comparatively-small particulates through an exhaust vent, not shown, into the ambient air. The wet/dry hand-held vacuum cleaner 10, when not in use, is stored on a base that recharges the battery, and stows any accessories, not shown.

Figure 2:
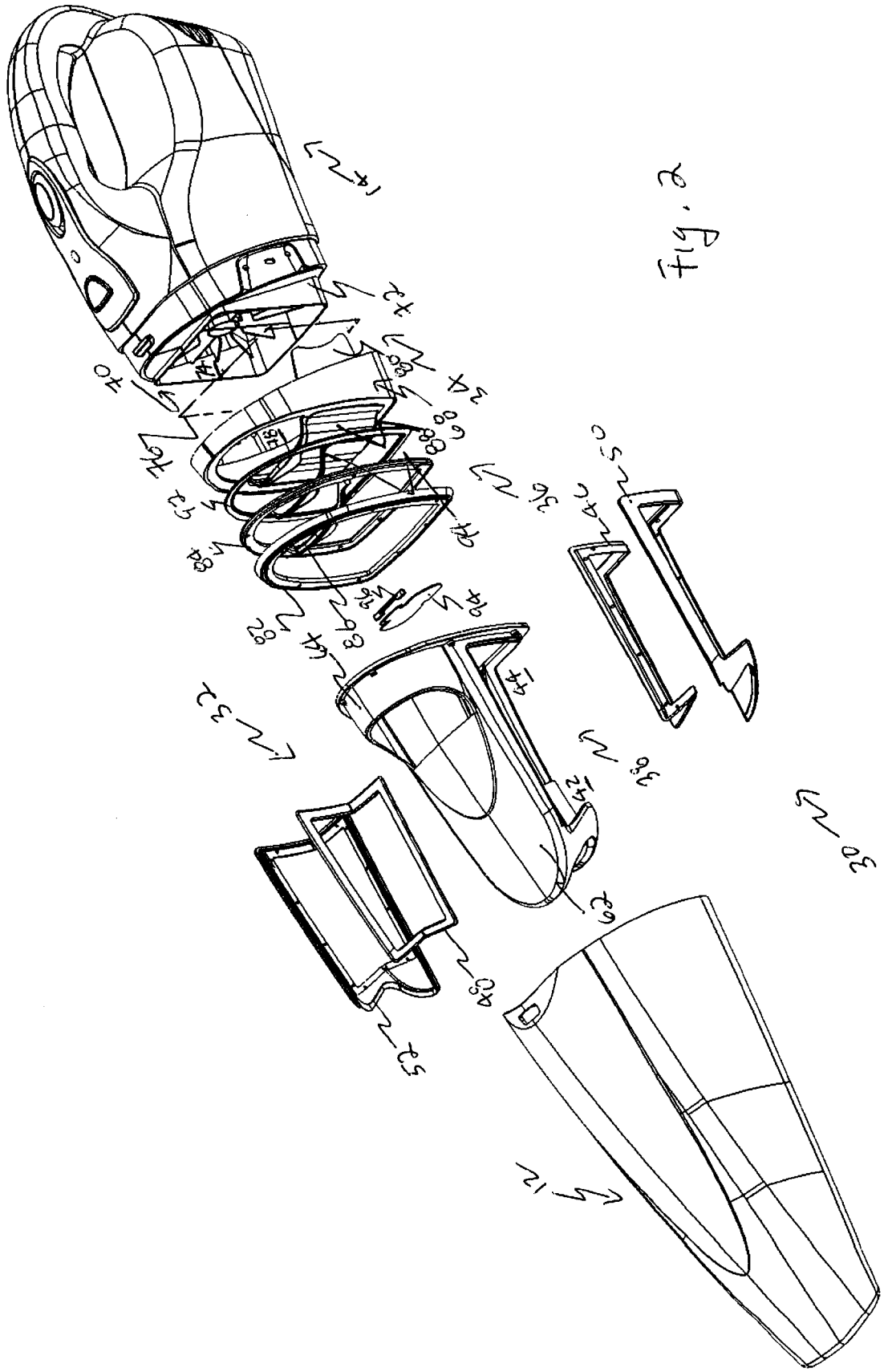
FIG. 2 is an exploded perspective view of the dual filter wet/dry hand-held vacuum cleaner of FIG. 1.

Referring now to FIG. 2, generally designated at 30 is an exploded perspective view of the dual filter wet/dry hand-held vacuum cleaner of the present invention. The vacuum cleaner 30 includes a first filter subassembly generally designated 32 slidably mounted in the dust bowl 12 and a second filter subassembly generally designated 34 intermediate the first filter 32 and the powered unit 14. The first filter 32 receives the inlet nozzle stream and discharges an air stream from which liquids and comparatively-large particulates have been separated, and the second filter 34 receives the air stream out of the first filter and discharges purified air cleaned of comparatively-small particulates.

A sealing subassembly generally designated 36 intermediate the confronting ends of the first and second filters 32, 34 prevents dirt and liquid ingress from the dust bowl 12 into the powered unit 14 and joins the first and second filter subassemblies 32, 34 in fluid-tight fluid communication. Any suitable first and second filters respectively providing comparatively-large and comparatively-small particulate removal, and any sealing arrangement suitable to prevent dirt and liquid ingress while providing fluid-tight fluid communication between the filters, may be employed without departing from the inventive concepts.

Figure 3:
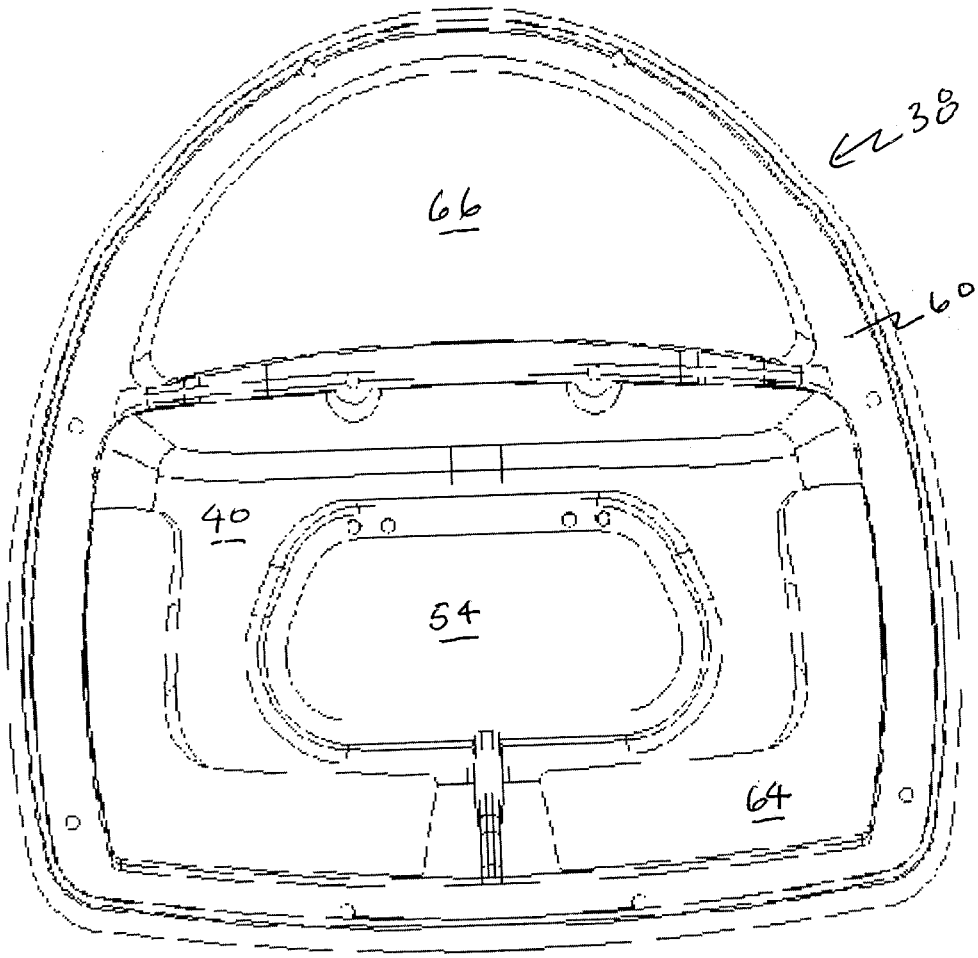
FIG. 3 is an end view of the frame of the first filter of the dual filter wet/dry hand-held vacuum cleaner of the present invention.
Figure 4:
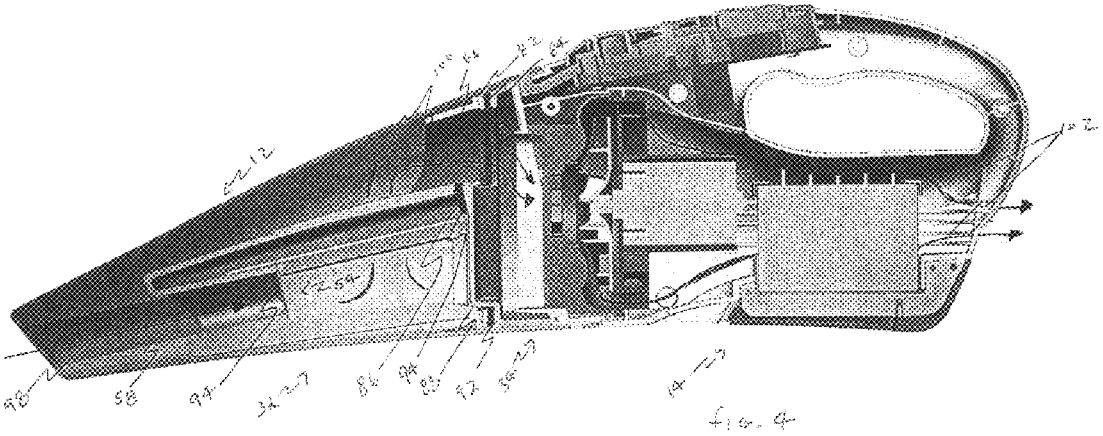
FIG. 4 is a longitudinal section taken along the lines 4—4 of FIG. 1 useful in explaining the operation of the dual filter wet/dry hand-held vacuum cleaner in accord with the present invention.

The first filter subassembly 32 includes an elongated frame generally designated 38 having top, and open bottom, side and end walls that bound an internal volume generally designated 40 as best seen in FIG. 3. As best seen in FIG. 4, the first filter 32 is substantially coextensive with a major portion of the dust bowl 12, which maximizes the particulate trapping capacity of the first filter and therewith minimizes the frequency with which it needs to be cleaned out.

In the open side and bottom walls generally designated 42, 44 are mounted metallic screens 46, 48 having an L-shaped cross-section, which are captured between screen support frames 50, 52, also having a L-shaped cross-section, and the frame member 38. The screen support frames 50, 52 may be adhesively, threadably, ultrasonically welded or otherwise fastened to the frame 38, and preferably are threadably fastened thereto. While L-shaped metallic screens 46, 48 of pore sizes between 0.3 mm to 0.5 mm which may vary smaller and larger dependent on the specific application requirements are presently preferred, any screening material of any configuration selected to trap comparatively-large particulates within the internal volume of the frame while passing comparatively-small particulates and liquids therethrough may be employed.

The frame 38 of the first filter 32 is provided with an open end generally designated 54, best seen in FIG. 3, that is adapted to receive intake nozzle 58 of dust bowl 12 as illustrated in FIG. 4. A peripheral flange 60 transversely extends from the other open end of the frame member 38 as is best seen in FIG. 3. The flange 60, together with the end of top wall 62 of the frame member 38, define an opening generally designated 63 best seen in FIG. 3 through which particulates trapped in the internal volume 40 of the frame 38 may be efficiently discharged at the time of emptying into a suitable trash receptacle with little or no direct contact with the accumulated grime and little or no dust generation.

An arcuate wall 64 joined at the sides to the top wall 62 longitudinally extends from the flange 60 towards the open nozzle end 54 of the frame 38 of the first filter subassembly 32. The arcuate wall 64, together with the confronting surface of the top wall 62, define a duct generally designated 66 best seen in FIG. 3 through which filtered air passes from the first filter 32 into the second filter 34.

The second filter subassembly 34 includes a cover member generally designated 68 removably attached to the dust bowl receiving face generally designated 70 of the powered unit 14; a flange 72 providing a flat filter mounting recess generally designated 74 peripherally formed about the dust bowl receiving face 70 of the powered unit 14; and one of a foamed plastic, a HEPA, and UPLA flat filter shown in dashed outline 76 that is removably mounted to the mounting recess 74 of the powered unit 14. Although a second filter subassembly 34 that includes a flat filter 76 is presently preferred, any second filter subassembly that is adapted to remove comparatively-small particulates may be employed.

The cover 68 of the second filter 34 includes an opening generally designated 78 that is registered with the duct 66 of the first filter 32, and has longitudinally extending side arms 80 that releasably resiliently engage the confronting sides of the powered unit 14, although any means for removably attaching the cover 68 to the powered unit 14 may be employed.

As will be readily appreciated, cleaning or replacement of the second filter is efficient and straightforward. At cleaning or replacement times, which are infrequent, since the second filter only removes comparatively-small particulates, which typically accumulate slowly over time, the cover member is released from the powered unit to expose the flat filter mounted in the filter mounting recess, which then may be readily removed. After it is cleaned, it is placed back in the mounting recess, or it may be replaced by another flat filter of the same or different type, after which the cover is reattached to the powered unit.

The sealing subassembly 36 includes a rubber seal member 82, captured by seal retainer frame 84, mounted to the flange 60 of the frame 38 of the first filter subassembly 32. The seal retainer frame 84 may be adhesively, threadably, ultrasonically welded or otherwise fastened to the flange 60, and preferably is threadably fastened thereto. The rubber seal member 82 prevents liquid and dirt ingress from the dust bowl 12 to the powered unit 14 as best seen in FIG. 4. While ring seal 82 is presently preferred, any peripheral seal arrangement adapted to prevent liquid and dirt ingress from the dust bowl to the powered unit may be employed.

The seal retainer frame 84 includes a transverse rib 86 that seats in the top of the open end 63 of the frame member 38 of the first filter subassembly 32 and provides a finger pull, which aids in slidably removing the first filter 32 from the dust bowl 12 at times of emptying, as best seen in FIG. 4.

The sealing subassembly 36 includes a rubber sealing pad 88 mounted to the outside face of the cover 68 of the second filter subassembly 34 that is of a width and height just larger than the width and height of the opening of the open end wall 63 of the frame 38 of the first filter 32. Although a rubber seal pad 88 is preferred, any suitable seal arrangement adapted to prevent dirt and liquid ingress from the open end 63 of the first filter 32 to the second filter subassembly 34 may be employed.

The sealing subassembly 36 further includes a rubber seal member 92 adhesively mounted to the outside face of the cover member 68 of the second filter 34 that has a rubber transverse seal member 94 in registration with both the end wall of the top 62 of the frame 38 of the first filter 32 and with the transverse rib 86 of the seal retainer frame 84 as best seen in FIG. 4. While ring seal member 92 with transverse seal member 94 adhesively mounted to the cover 68 of the second filter subassembly 34 is presently preferred, any seal arrangement adapted to peripherally seal the confronting ends of the first and second filter subassemblies and of the duct and registered opening thereof may be employed.

A flap 94, retained by fastener 96, is pivotally mounted to the distal end of the inlet nozzle, which acts as a one-way valve, allowing air and entrained dirt and liquids to enter the interior volume of the first filter while preventing entrapped particulates from exiting out the inlet nozzle as best seen in FIG. 4.

In operation, and referring now to FIG. 4, inlet air schematically illustrated by arrow 98 that may have entrained liquids and particulates is discharged into the interior volume 40 of the first filter subassembly 32. The first filter 32 discharges an airstream schematically illustrated by arrows 100 from which liquids and comparatively-large particulates have been separated. As will readily be appreciated, any liquids in the inlet nozzle stream are collected in the bottom of the dust bowl 12. The airstream 100 flows through the duct 66 and the registered opening 78 into the second filter subassembly 34, where the flat filter removes comparatively-small particulates therefrom. The powered unit 14 exhausts purified air cleaned of liquids, comparatively-large particulates and comparatively-small particulars as schematically illustrated by arrows 102.

Many embodiments, variations and modifications of the presently disclosed invention will become apparent to those of skill in the art without departing from the inventive concepts.

What is claimed is:

1. A dual filter wet/dry hand-held vacuum cleaner picking up both liquids and solid particulates and providing exhaust air filtered of liquids and such comparatively-large solid particulates as dirt and dust and purified of such comparatively-small solid particulates as fine dust and allergens, comprising:

a powered unit having a suction face, an exhaust port and a motor-driven fan drawing air into said suction face and exhausting the air that is drawn into said suction face out through the exhaust port thereof, an elongated dust bowl removably attached to the powered unit having an intake nozzle in fluid communication with the suction face that discharges an intake nozzle stream in which comparatively-large and comparatively-small solid particulates, and liquids, may have been entrained;

a first filter subassembly in the dust bowl responsive to the intake nozzle stream provided by said intake nozzle of said elongated dust bowl and adapted to discharge filtered air from which both liquids and comparatively-large solid particulates, that may have been entrained in said intake nozzle stream, have been removed, but in which comparatively-small solid particulates that may have been entrained in said intake nozzle stream remain; and a second filter subassembly in the dust bowl responsive to said filtered air provided by said first filter subassembly and adapted to discharge purified air from which any comparatively-small solid particulates that remain entrained in said filtered air provided by said first filter subassembly have been removed; whereby, said purified air, is drawn into said suction face of said powered unit, and discharged through said exhaust port of said powered unit, providing thereby exhaust air, filtered of liquids and such comparatively-large solid particulates as dirt and dust, and purified of such comparatively-small solid particulates as fine dust and allergens.

2. The dual filter wet/dry hand-held vacuum cleaner of claim 1, further including at least one seal member intermediate said first and said second filter subassemblies.

3. The dual filter wet/dry hand-held vacuum cleaner of claim 1, wherein the first filter subassembly includes a frame member slidably mounted in the dust bowl that is substantially coextensive with a major portion of the dust bowl, which maximizes the solid particulates trapping capacity of the first filter subassembly and therewith minimizes the frequency with which the first filter subassembly needs to be emptied of accumulated grime.

4. The dual filter wet/dry hand-held vacuum cleaner of claim 3, wherein the frame member has top, open bottom, and open side and end walls that bound an interior volume; wherein screens are mounted to the open side and bottom walls of the frame member of the first filter subassembly to remove comparatively-large solid particulates and liquids from the intake nozzle stream; wherein one open end wall of the frame member is adapted to receive the intake nozzle so that it discharges into the interior volume of the frame member of the first filter subassembly; and wherein the other open end wall of the frame member permits, at emptying time, any accumulated comparatively-large solid particulates to be discharged through that open end of the frame member directly into a suitable trash receptacle, which minimizes dust generation and direct user contact with dirt.

5. The dual filter wet/dry hand-held vacuum cleaner of claim 1, wherein the second filter subassembly includes a cover member removably attached to the suction face of the powered unit; a flange providing a flat filter mounting recess formed about the suction face of the powered unit; and one of a foamed plastic flat filter, a HEPA filter and an UIPA filter that is removably mounted to the mounting recess of the powered unit.

6. Cleaning apparatus that provides effective filtration of liquids and comparatively-large and comparatively-small solid particulates, comprising:

a vacuum producing subassembly having a vacuum inlet opening in fluid communication with an air exhaust outlet opening; and a two-stage filter subassembly intermediate the vacuum inlet opening and the air exhaust outlet opening of said vacuum producing subassembly, the first stage of said two-stage filter includes a first, stationary flow-through filter that is adapted to remove both comparatively-large solid particulates, and liquids, entering the vacuum inlet opening but to allow comparatively-small solid particulates to pass thereinthrough, and the second stage of said two-stage filter includes a second, stationary flow-through filter that is adapted to remove comparatively-small solid particulates entering the second stage from the first stage and to exhaust into the air exhaust outlet opening purified air, cleaned, in the first stage of the two-stage filter, both of comparatively-large solid particulates and liquids, and cleaned, in the second stage of the two-stage filter, of comparatively-small sold particulates.

7. The cleaning apparatus of claim 6, wherein said vacuum producing subassembly is a wet/dry vacuum cleaner.

8. The cleaning apparatus of claim 7, wherein said wet/dry vacuum cleaner is a hand-held wet/dry vacuum cleaner having an elongated dust bowl removably attached to a powered unit.

9. The cleaning apparatus of claim 8, wherein said stationary flow-through filter of said first stage of said two-stage filter includes a frame member having walls bounding an internal volume, wherein at least one of said walls includes a screen of mesh size adapted to trap comparatively-large solid particulates in said internal volume and adapted to pass comparatively-small solid particulates and liquids.

10. The cleaning apparatus of claim 6, wherein said stationary second flow-through filter of said second stage of said two-stage filter is a foamed plastic flat filter element.

11. The cleaning apparatus of claim 6, wherein said stationary second flow-through filter of said second stage of said two-stage filter is a HEPA flat filter element.

12. The cleaning apparatus of claim 6, wherein said stationary second flow-through filter of said second stage of said two-stage filter is an ULPA flat filter element.

13. The dual filter wet/dry hand-held vacuum cleaner of claim 1, wherein the second filter subassembly includes a HEPA filter.

14. The dual filter wet/dry hand-held vacuum cleaner of claim 1, wherein the second filter subassembly includes an ULPA filter.

* * * * *